US012805574B2

(12) United States Patent
Stump et al.

(10) Patent No.: US 12,805,574 B2
(45) Date of Patent: Nov. 24, 2026

(54) HARDWARE ACTIVATION OF A CONTROLLED DEVICE

(71) Applicant: RAI STRATEGIC HOLDINGS, INC., Winston-Salem, NC (US)

(72) Inventors: Ryan Stump, Costa Mesa, CA (US); Ed Carmines, Scottsdale, AZ (US)

(73) Assignee: RAI STRATEGIC HOLDINGS, INC., Winston-Salem, NC (US)

( * ) Notice: Subject to any disclaimer, the term of this patent is extended or adjusted under 35 U.S.C. 154(b) by 734 days.

(21) Appl. No.: 18/205,427

(22) Filed: Jun. 2, 2023

(65) Prior Publication Data

US 2024/0398026 A1 Dec. 5, 2024

(51) Int. Cl.
*A24F 40/50* (2020.01)
*A24F 40/65* (2020.01)

(52) U.S. Cl.
CPC ..... *A24F 40/50* (2020.01); *A24F 40/65* (2020.01)

(58) Field of Classification Search
CPC ..... A24F 40/50; A24F 40/65; H04L 9/006; H04L 9/0844; H04L 9/32; G06F 21/1077
See application file for complete search history.

(56) References Cited

U.S. PATENT DOCUMENTS 4,639,368 A 1/1987 Niazi et al.
4,735,217 A 4/1988 Gerth et al.
4,807,809 A 2/1989 Pryor et al.
4,836,224 A 6/1989 Lawson et al.
4,889,143 A 12/1989 Pryor et al.
4,922,901 A 5/1990 Brooks et al.
4,924,888 A 5/1990 Perfetti et al.
4,947,874 A 8/1990 Brooks et al.
4,947,875 A 8/1990 Brooks et al.
(Continued)

FOREIGN PATENT DOCUMENTS

WO WO 97/06786 2/1997
WO WO 02/37990 5/2002
(Continued)

OTHER PUBLICATIONS

Hawkins, B. et al., "Vibrating Mesh Nebulizer Reference Design," *Microchip*, Microchip Technology, Inc., AN2265, 2016-2017, pp. 1-50.

(Continued)

*Primary Examiner* — Quazi Farooqui
(74) *Attorney, Agent, or Firm* — Womble Bond Dickinson (US) LLP

(57) ABSTRACT

This disclosure describes a system and method for preventing unauthorized use of a personal vaporizer or other controlled device. A software/hardware lock can be installed by the manufacturer on the personal vaporizer, which requires a hardware authenticator key and an activation code to "unlock" or "activate" the personal vaporizer for user. This prevents unauthorized (e.g., under-age) users from abusing the controlled device. Further if the controlled device needs to be uniquely activated, a stolen device, or one that has been tampered with in an unauthorized manner can be prevented from use or "bricked," further enabling the manufacturer or seller of the personal vaporizer to ensure the device is not abused.

20 Claims, 6 Drawing Sheets

(56) References Cited

U.S. PATENT DOCUMENTS 5,025,814 A 6/1991 Raker
5,056,537 A 10/1991 Brown et al.
5,060,671 A 10/1991 Counts et al.
5,093,894 A 3/1992 Deevi et al.
5,154,192 A 10/1992 Sprinkel et al.
5,159,942 A 11/1992 Brinkley et al.
5,178,878 A 1/1993 Wehling et al.
5,220,930 A 6/1993 Gentry
5,223,264 A 6/1993 Wehling et al.
5,224,498 A 7/1993 Deevi et al.
5,228,460 A 7/1993 Sprinkel et al.
5,249,586 A 10/1993 Morgan et al.
5,261,424 A 11/1993 Sprinkel, Jr.
5,322,075 A 6/1994 Deevi et al.
5,353,813 A 10/1994 Deevi et al.
5,360,023 A 11/1994 Blakley et al.
5,372,148 A 12/1994 McCafferty et al.
5,388,594 A 2/1995 Counts et al.
5,498,850 A 3/1996 Das
5,498,855 A 3/1996 Deevi et al.
5,530,225 A 6/1996 Hajaligol
5,573,692 A 11/1996 Das et al.
5,591,368 A 1/1997 Fleischhauer et al.
5,659,656 A 8/1997 Das
5,665,262 A 9/1997 Hajaligol et al.
5,666,977 A 9/1997 Higgins et al.
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,164,287 A 12/2000 White
6,196,218 B1 3/2001 Voges
6,701,936 B2 3/2004 Shafer et al.
6,772,756 B2 8/2004 Shayan
6,803,545 B2 10/2004 Blake et al.
6,810,883 B2 11/2004 Felter et al.
6,854,461 B2 2/2005 Nichols et al.
6,974,590 B2 12/2005 Pather et al.
7,011,096 B2 3/2006 Li et al.
7,017,585 B2 3/2006 Li et al.
7,025,066 B2 4/2006 Lawson et al.
7,040,314 B2 5/2006 Nguyen et al.
7,293,565 B2 11/2007 Griffin et al.
7,381,667 B2 6/2008 Bergquist et al.
7,513,253 B2 4/2009 Kobayashi et al.
7,726,320 B2 6/2010 Robinson et al.
7,832,410 B2 11/2010 Hon
7,896,006 B2 3/2011 Hamano et al.
8,156,944 B2 4/2012 Han
8,205,622 B2 6/2012 Pan
8,365,742 B2 2/2013 Hon
8,375,957 B2 2/2013 Hon
8,402,976 B2 3/2013 Fernando et al.
8,424,538 B2 4/2013 Thomas et al.
8,424,541 B2 4/2013 Crawford et al.
8,464,726 B2 6/2013 Sebastian et al.
8,499,766 B1 8/2013 Newton
8,528,569 B1 9/2013 Newton
8,539,959 B1 9/2013 Scatterday
8,627,828 B2 1/2014 Strickland et al.
8,689,804 B2 4/2014 Fernando et al.
8,794,231 B2 8/2014 Thorens et al.
8,851,083 B2 10/2014 Oglesby et al.
8,881,737 B2 11/2014 Collett et al.
8,910,639 B2 12/2014 Chang et al.
8,910,640 B2 12/2014 Sears et al.
8,915,254 B2 12/2014 Monsees et al.
8,925,555 B2 1/2015 Monsees et al.
9,078,473 B2 7/2015 Worm et al.
9,220,302 B2 12/2015 DePiano et al.
9,254,002 B2 2/2016 Chong et al.
9,307,787 B2 4/2016 Sun et al.
9,423,152 B2 8/2016 Ampolini et al.
9,427,022 B2 8/2016 Levin et al.
9,439,454 B2 9/2016 Fernando et al.
9,451,791 B2 9/2016 Sears et al.
9,484,155 B2 11/2016 Peckerar et al.
9,955,733 B2 5/2018 Sur et al.
10,440,999 B2 10/2019 Tremblay
11,551,195 B2 * 1/2023 Anbukkarasu ..... G06Q 20/308
11,676,438 B2 6/2023 Hubbard et al.
11,783,395 B2 10/2023 Hubbard et al.
11,935,350 B2 3/2024 Hubbard
12,232,543 B2 2/2025 Daugherty
12,246,129 B2 3/2025 Terry et al.
12,283,148 B2 4/2025 Hubbard et al.
12,550,944 B2 2/2026 Daugherty et al.
2004/0255965 A1 12/2004 Perfetti et al.
2005/0016550 A1 1/2005 Katase
2006/0147083 A1 * 7/2006 Piersol ..... G06F 21/16 382/306
2006/0196518 A1 9/2006 Hon
2008/0149118 A1 6/2008 Oglesby et al.
2009/0095311 A1 4/2009 Han
2009/0126745 A1 5/2009 Hon
2009/0188490 A1 7/2009 Han
2009/0260641 A1 10/2009 Monsees et al.
2009/0260642 A1 10/2009 Monsees et al.
2009/0272379 A1 11/2009 Thorens et al.
2010/0018539 A1 1/2010 Brinkley et al.
2010/0024834 A1 2/2010 Oglesby et al.
2010/0186757 A1 7/2010 Crooks et al.
2010/0307518 A1 12/2010 Wang
2010/0313901 A1 12/2010 Fernando et al.
2011/0041861 A1 2/2011 Sebastian et al.
2012/0055494 A1 3/2012 Hunt et al.
2013/0008457 A1 1/2013 Zheng et al.
2013/0180553 A1 7/2013 Gaus et al.
2013/0192623 A1 8/2013 Tucker et al.
2013/0243410 A1 9/2013 Nichols et al.
2013/0255702 A1 10/2013 Griffith, Jr. et al.
2014/0000638 A1 1/2014 Sebastian et al.
2014/0014125 A1 1/2014 Fernando et al.
2014/0096781 A1 4/2014 Sears et al.
2014/0261487 A1 9/2014 Chapman et al.
2014/0261495 A1 9/2014 Novak, III et al.
2014/0283855 A1 9/2014 Hawes et al.
2015/0020823 A1 1/2015 Lipowicz et al.
2015/0020830 A1 1/2015 Koller
2015/0059780 A1 3/2015 Davis et al.
2015/0083150 A1 3/2015 Conner et al.
2015/0157052 A1 6/2015 Ademe et al.
2015/0216232 A1 8/2015 Bless et al.
2015/0220232 A1 8/2015 Smith et al.
2015/0224268 A1 8/2015 Henry et al.
2015/0245658 A1 9/2015 Worm et al.
2015/0245659 A1 9/2015 DePiano et al.
2015/0257445 A1 9/2015 Henry, Jr. et al.
2016/0007651 A1 1/2016 Ampolini et al.
2016/0158782 A1 6/2016 Henry, Jr. et al.
2016/0219933 A1 8/2016 Henry, Jr. et al.
2016/0261020 A1 9/2016 Marion et al.
2016/0262454 A1 9/2016 Sears et al.
2017/0000188 A1 1/2017 Nordskog et al.
2017/0099877 A1 4/2017 Worm et al.
2017/0112191 A1 4/2017 Sur et al.
2017/0112196 A1 4/2017 Sur et al.
2017/0127722 A1 5/2017 Davis et al.
2017/0202266 A1 7/2017 Sur
2018/0132528 A1 5/2018 Sur et al.
2018/0132531 A1 5/2018 Sur et al.
2019/0014819 A1 1/2019 Sur
2019/0082735 A1 3/2019 Phillips et al.
2019/0124979 A1 5/2019 Sebastian et al.
2019/0174823 A1 6/2019 Sur
2019/0274353 A1 9/2019 Sur
2019/0274354 A1 9/2019 Sur et al.
2020/0000143 A1 * 1/2020 Anderson ..... G06F 21/32
2022/0079242 A1 3/2022 Daugherty et al.
2022/0269763 A1 * 8/2022 Lett ..... A61M 11/041

(56) References Cited

U.S. PATENT DOCUMENTS

| | | | |
|---|---|---|---|
| 2024/0057680 | A1 | 2/2024 | Daugherty et al. |
| 2024/0289425 | A1 | 8/2024 | Milici et al. |

FOREIGN PATENT DOCUMENTS

| | | |
|---|---|---|
| WO | WO 2010/003480 | 1/2010 |
| WO | WO 2010/091593 | 8/2010 |
| WO | WO 2013/089551 | 6/2013 |
| WO | WO 2014/182736 | 11/2014 |

OTHER PUBLICATIONS

Bombick et al., "Evaluation of the Genotoxic and Cytotoxic Potential of Mainstream Whole Smoke and Smoke Condensate from a Cigarette Containing a Novel Carbon Filter," *Fundamental and Applied Toxicology*, 1997, vol. 39, pp. 11-17.

* cited by examiner

HARDWARE ACTIVATION OF A CONTROLLED DEVICE

This disclosure generally relates to securely activating a controlled device.

BACKGROUND

Personal vaporizers or electronic vapor delivery systems (EVDS) are subject to a high level of regulatory scrutiny. It is currently illegal for minors to purchase tobacco products, and limiting their access to tobacco products or other regulated substances is of interest to both sales entities and manufacturers.

SUMMARY

In general, the disclosure involves a system, non-transitory computer readable medium, and a method for activating a controlled device such as a personal vaporizer or electronic vapor delivery system. This includes receiving, by a computing device, a user identification (ID) associated with a user that is to be authenticated. Verifying, by the computing device, that the user is authorized based on confirming the user ID with a database of authorized users. Receiving a device ID that uniquely identifies a personal vaporizer or controlled device to be activated and a key ID that uniquely identifies a hardware authenticator key configured to activate the personal vaporizer. Generating, by the computing device, a machine readable code in response to a successful verification, the machine readable code including and activation code that enables operation of the personal vaporizer, the machine readable code generated based on the device ID and the key ID. Providing the machine readable code to be scanned by the hardware authenticator key.

Implementations can optionally include one or more of the following features.

In some instances, generating the machine readable code includes generate a QR code, and providing the machine readable code to be scanned includes presenting the QR code on a display device associated with the computing device.

In some instances, the activation code, when transmitted by the hardware authenticator key to the personal vaporizer, enables operation of the personal vaporizer.

In some instances, generating the machine readable code includes: retrieving the activation code from a repository, and generating the machine readable code to be specific to the hardware authenticator key based on the key ID. The activation code can be specific to the personal vaporizer to be activated.

In some instances, the activation code is embedded into the machine readable code using a public key of the hardware authenticator key, and the activation code is configured to be extracted from the machine readable code using a private key of the hardware authenticator key.

In some instances, verifying that the user is authorized includes querying an application programming interface (API) of a third party system.

In some instances, verifying that the user is authorized includes receiving biometric information associated with the user and verifying the biometric information.

Additionally, this disclosure describes a device, method, and system for providing hardware authentication. The device includes: a scanner configured to scan a machine readable code and extract a digital code from the machine readable code, a communications interface, and a controller that can receive the digital code from the scanner, extract an activation code by decrypting the digital code, and send the activation code through the communications interface to an inoperable personal vaporizer, activating the personal vaporizer, where activating the personal vaporizer enables operation of the previously inoperable personal vaporizer.

Implementations can optionally include one or more of the following features.

In some instances, the controller is configured to send the activation code for a limited period of time following receipt of the digital code.

In some instances, the controller can verify the digital code has not been previously received from the scanner prior to sending the activation code.

In some instances, the activation code is configured to be written to an EPROM or EEPROM memory in the personal vaporizer, the EPROM or EEPROM memory is configured to be erased periodically by the personal vaporizer, and the personal vaporizer is rendered inoperable when the activation code is not written to the EPROM or EEPROM memory.

In some instances, the machine readable code is a QR code.

In some instances, the communications interface is a universal asynchronous receiver-transmitter (UART) interface.

In some instances, decrypting the digital code includes using a private key associated with the hardware authenticator key.

The details of one or more implementations of the subject matter of this specification are set forth in the accompanying drawings and the description below. Other features, aspects, and advantages of the subject matter will become apparent from the description, the drawings, and the claims.

DESCRIPTION OF DRAWINGS

This disclosure relates to securely activating a controlled device.

DETAILED DESCRIPTION

This disclosure describes a system and method for securely activating a controlled device. Certain controlled devices, such as electronic vapor delivery systems, e-cigarettes, or personal vaporizers can deliver regulated substances (e.g., tobacco, THC, or others) to a user in a clean, environmentally friendly manner.

In order to ensure the correct user (e.g., owner) of the personal vaporizer is the only one with access to it, a software/hardware lock can be installed by the manufacturer on the personal vaporizer, which requires a hardware authenticator key and an activation code to "unlock" or "activate" the personal vaporizer for user. This prevents unauthorized (e.g., under-age) users from accessing or using the controlled device. Further if the controlled device needs to be uniquely activated, a stolen device, or one that has been tampered with in an unauthorized manner can be prevented from use or "bricked," further enabling the manufacturer or seller of the personal vaporizer to ensure the device is not abused.

The disclosed solution for ensuring only authorized access to a controlled device (e.g., personal vaporizer, firearm, prescription medicine) is advantageous in that it does not require any dedicated software download to any user device, ensures secure activation of the controlled device by an authorized user, and can be seamlessly or "frictionlessly" integrated into the current sales infrastructure.

Specifically, when the controlled device is initially sold, it is sold in an inactive or deactivated state, and is inoperable until it receives an activation code, which can be stored in a local memory (e.g., EPROM memory, EEPROM memory, flash memory, or others). A unique hardware authenticator key can be provided, which can be registered to a specific user and has a unique hardware identification (ID). The user can provide verification/credentials to a web based service, as well as the hardware ID of the hardware authenticator key, and a device ID of the controlled device to be activated. The backend server using these various ID's and asymmetric encryption can generate a unique activation code that can be scanned only by the particular hardware authenticator key register with the user, which can then extract an activation code and transmit it to the controlled device, activating the controlled device.

Figure 1:
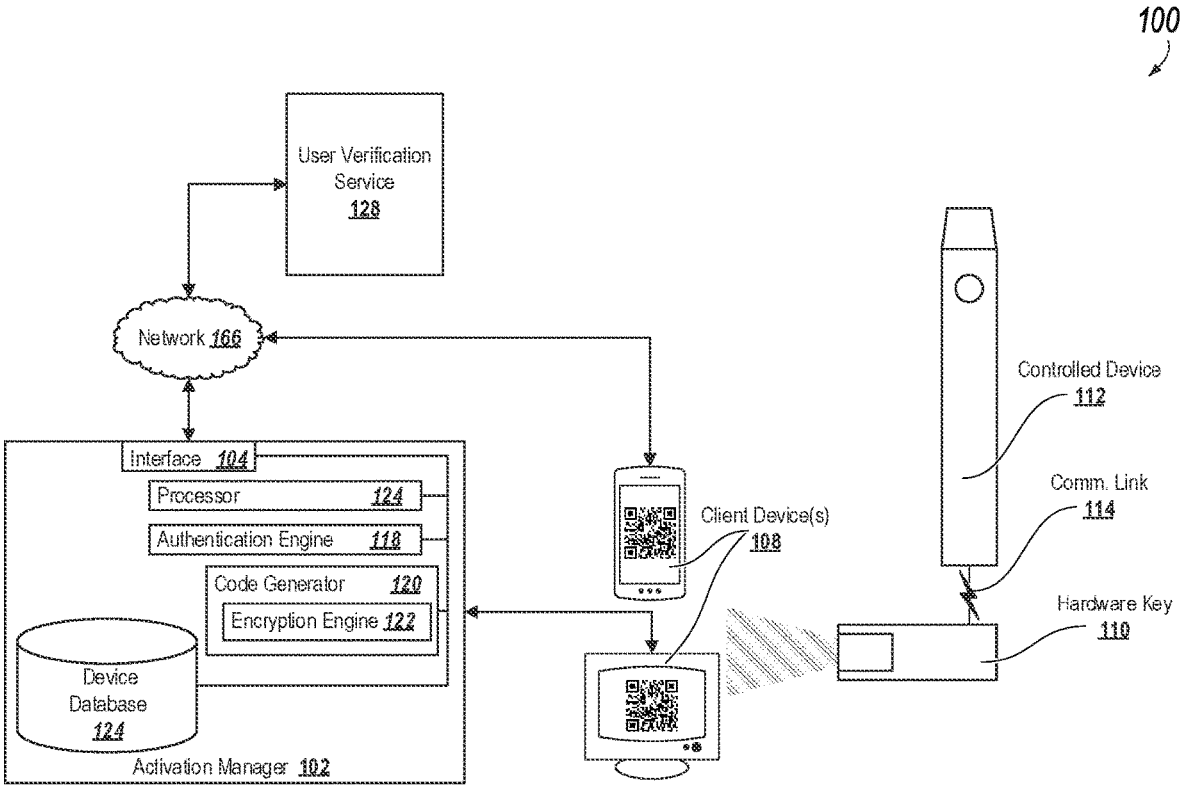
FIG. 1 depicts an example architecture for securely activating a controlled device.

FIG. 1 depicts an example architecture for a system 100 for securely activating a controlled device. The controlled device 112 can be initially in a deactivated, or otherwise inoperable state. In order to be activated it can require an activation code that is obtainable using activation manager 102, client device(s) 108, and hardware key 110 of system 100.

Activation manager 102 can be a backend server system, or cloud platform, that securely manages activation codes for controlled devices (e.g., controlled device 112). Activation manager 102 includes a device database 124, code generator 120, authentication engine 118, and one or more interfaces 104.

Interface 104 is used by the activation manager 102 for communicating with other systems in a distributed environment—including within the system 100—connected to the network 166, including client devices 108, user verification service 126, and other systems communicably coupled to the activation manager 102 and/or network 166. Generally, the interface 104 includes logic encoded in software and/or hardware in a suitable combination and operable to communicate with the network 166 and other components. More specifically, the interface 104 can include software supporting one or more communication protocols associated with communications such that the network 166 and/or interface's hardware is operable to communicate physical signals within and outside of the illustrated system 100.

Network 166 facilitates wireless or wireline communications between the components of the system 100 (e.g., between the activation manager 102, client devices 108, and user verification service 128, etc.), as well as with any other local or remote computers, such as additional mobile devices, clients, servers, or other devices communicably coupled to network 166, including those not illustrated in FIG. 1. In the illustrated environment, the network 166 is depicted as a single network, but can include more than one network without departing from the scope of this disclosure, so long as at least a portion of the network 166 can facilitate communications between senders and recipients. In some instances, one or more of the illustrated components (e.g., the device database 124, the code generator 120, etc.) can be included within or deployed to network 166, or a portion thereof, as one or more cloud-based services or operations. The network 166 can be all or a portion of an enterprise or secured network, while in another instance, at least a portion of the network 166 can represent a connection to the Internet. In some instances, a portion of the network 166 can be a virtual private network (VPN). Further, all or a portion of the network 166 can comprise either a wireline or wireless link. Example wireless links can include 802.11a/b/g/n/ac, 802.20, WiMax, LTE, and/or any other appropriate wireless link. In other words, the network 166 encompasses any internal or external network, networks, sub-networks, or combination thereof operable to facilitate communications between various computing components inside and outside the illustrated system 100. The network 166 can communicate, for example, Internet Protocol (IP) packets, Frame Relay frames, Asynchronous Transfer Mode (ATM) cells, voice, video, data, and other suitable information between network addresses. The network 166 can also include one or more local area networks (LANs), radio access networks (RANs), metropolitan area networks (MANs), wide area networks (WANs), all or a portion of the Internet, and/or any other communication system or systems at one or more locations.

Activation manager 102 also includes one or more processors 124. Although illustrated as a single processor 124 in FIG. 1, multiple processors can be used according to particular needs, desires, or particular implementations of the system 100. Each processor 124 can be a central processing unit (CPU), an application specific integrated circuit (ASIC), a field-programmable gate array (FPGA), or another suitable component. Generally, the processor 124 executes instructions and manipulates data to perform the operations of the Activation manager 102. Specifically, the processor 124 executes the algorithms and operations described in the illustrated figures, as well as the various software modules and functionality, including the functionality for sending communications to and receiving transmissions from the client devices 108, as well as to other devices and systems (e.g., a local display, or user verification service 128). Each processor 124 can have a single or multiple core, with each core available to host and execute an individual processing thread. Further, the number of, types of, and particular processors 124 used to execute the operations described herein can be dynamically determined based on a number of requests, interactions, and operations associated with the activation manager 102.

Regardless of the particular implementation, "software" includes computer-readable instructions, firmware, wired and/or programmed hardware, or any combination thereof on a tangible medium (transitory or non-transitory, as appropriate) operable when executed to perform at least the processes and operations described herein. In fact, each software component can be fully or partially written or described in any appropriate computer language including C, C++, JavaScript, Java™, Visual Basic, assembler, Perl®, any suitable version of 4GL, as well as others.

The activation manager 102 can include, among other components, several applications, entities, programs, agents, or other software or similar components capable of performing the operations described herein. As illustrated, the activation manager 102 includes, or is associated with, the authentication engine 118, and the code generator 120.

In general, authentication engine 118 performs operations necessary for verifying the authenticity and eligibility of a user to receive an activation code and activate the controlled device 112. In some implementations, authentication engine 118 maintains a database or list of authorized users, with each user having an associated set of credentials. The authentication engine 118 receives user credentials and verifies the user is in the database of authorized users before authenticating the user. In some implementations, the authentication engine 118 receives credentials or other identification associated with the user (e.g., name, date of birth, social security number, or username and password, etc.) and performs an API call to a third party user verification service 128.

In some implementations, communications between the activation manager 102 and the client devices 108 are encrypted, or verified by encryption. For example, messages sent by the client device 108 can include a digital signature of that client device 108, ensuring the sender of the message is authentic.

User verification service 128 can be a third party system that maintains records on users and establishes whether they are of legal age to activate or operate the controlled device 112. An example user verification service 128 could be bluecheck.me, which, in response to an API request, can verify the age of a user based on the provided credentials or user identification. In some implementations, user verification service 128 provides a pass/fail result to the authentication engine 118. In some implementations, the authentication engine 118 provides additional details at the request of the user verification service 128 in order to authenticate the user.

When the user has been authenticated (e.g., verified to be 18 years or older), the activation manager 102 can then provide an activation code for the user to use can activate their controlled device 112. The code generator 120 can generate a machine readable code that is suitable for use by a hardware authenticator key (e.g., hardware key 110) to activate the controlled device 112. In some implementations the activation code is provided as an encrypted code within a machine readable code such as a bar code or a QR code. The machine readable code can be scanned by the hardware key 110 (e.g., using an optical scanner, NFC communications, Bluetooth, RFID, etc.) and decrypted by the hardware key 110, then communicated using a communications link 114 to the controlled device. The communications link 114 can be a serial communications port, e.g., USB, or other port that requires physical contact between the hardware key and the controlled device. In some implementations, the communications link 114 is a pair of spring or magnetic contacts. In some implementations, the communications link 114 includes a male/female plug combination. In some implementations, the communications link 114 is a universal asynchronous receiver-transmitter (UART) connection. A UART connection can be configured and programmed as half-duplex such that transmission and reception of data will be done one at a time. Thus only a single pin is required to send and receive either QR code or data to and from the controlled device. In some implementations the communications link 114 is wireless, and relies on near field communications (NFC), Bluetooth, WIFI, or other communications protocol.

The code generator 120 can generate the machine readable code by accessing a device database 124, which can store a repository of controlled device ID's and their associated activation codes. Each controlled device 112 can have a unique activation code. For example, a given controlled device's activation code can be a hash of its device ID, combined with a secret salt, or private key associated with the activation manager. Upon receipt (e.g., from a previously authenticated user, or simultaneously with a request to authenticate a user) of a device ID of a controlled device to be activated, and a key ID of a hardware key to do the activation, the encryption engine can take an activation code associated with the particular controlled device 112 to be activated, and encrypt it using a public key of the particular hardware key 110 to do the activation. The encrypted activation code can then be embedded in a machine readable code by the code generator 120 and provided for scanning by the hardware key 110.

Client device(s) 108 can include mobile devices such as smartphones, tablets, or laptop computers, and/or other computing devices operable by the client or someone associated with the client. For example client devices 108 can include point-of-sale (POS) terminals, or a terminal directly associated with activation manager 102. The client devices 108 can be any system that can request data and/or interact with the activation manager 102. The client devices 108, in some instances, can be a desktop system, a client terminal, or any other suitable device, including a mobile device, such as a smartphone, tablet, smartwatch, or any other mobile computing device. In general, each illustrated component can be adapted to execute any suitable operating system, including Linux, UNIX, Windows, Mac OS®, Java™, Android™, Windows Phone OS, or iOS™, among others. The client devices 108 can include one or more specific applications executing on the client device 108, or the client devices 108 can include one or more web browsers or web applications that can interact with particular applications executing remotely from the client device 108. For example, the age verification process can be performed in part on the client device 108, which can, for example, record biometric credentials and receive a token from user verification service 128 before making the request to authentication engine 118 to be authenticated.

Hardware key 110 is any suitable device for scanning a machine readable code provided by the activation manager 102, extracting an activation code from the machine readable code, and activating a controlled device 112. In some implementations the hardware key 110 includes a unique key ID, which has an associated private/public key pair. Activation codes can be encrypted using the public key of the hardware key 110 and embedded in a machine readable code. The encrypted activation code can then be decrypted using the private key of the hardware key 110. In this manner, it is guaranteed that only the hardware key 110 can extract the activation key from the machine readable code, and a scan by an unauthorized device (e.g., a photo of a QR code taken by a bystander) will not be usable to activate the controlled device 112. While asymmetric encryption has been described, symmetric encryption could further be used, where the hardware key and the activation manager share a common, secret encryption key for encrypting and decrypting activation codes within the machine readable code.

Controlled device 112 can be any device in which the manufacturer or seller wants to limit access to. Controlled device 112 can be initially sold in an inert, inoperable, or otherwise deactivated manner, requiring a unique activation code to become active. In some implementations the controlled device 112 is a personal vaporizer, which contains one or more regulated substances such as nicotine, tobacco, CBD, THC, or other substances. An example personal vaporizer is illustrated and described below with respect to FIG. 6. A personal vaporizer can be disabled using an electronic switch, which prevents power from being supplied to critical operating components such as a heating element, puff sensor, or other component.

While illustrated as two separate components, it should be noted that hardware key 110 and controlled device 112 could be integrated, sharing the same physical structure. In some implementations, the controlled device 112 itself could contain the hardware key 110, and be configured to scan the machine readable code, decrypt the activation key, and activate itself.

Figure 2:
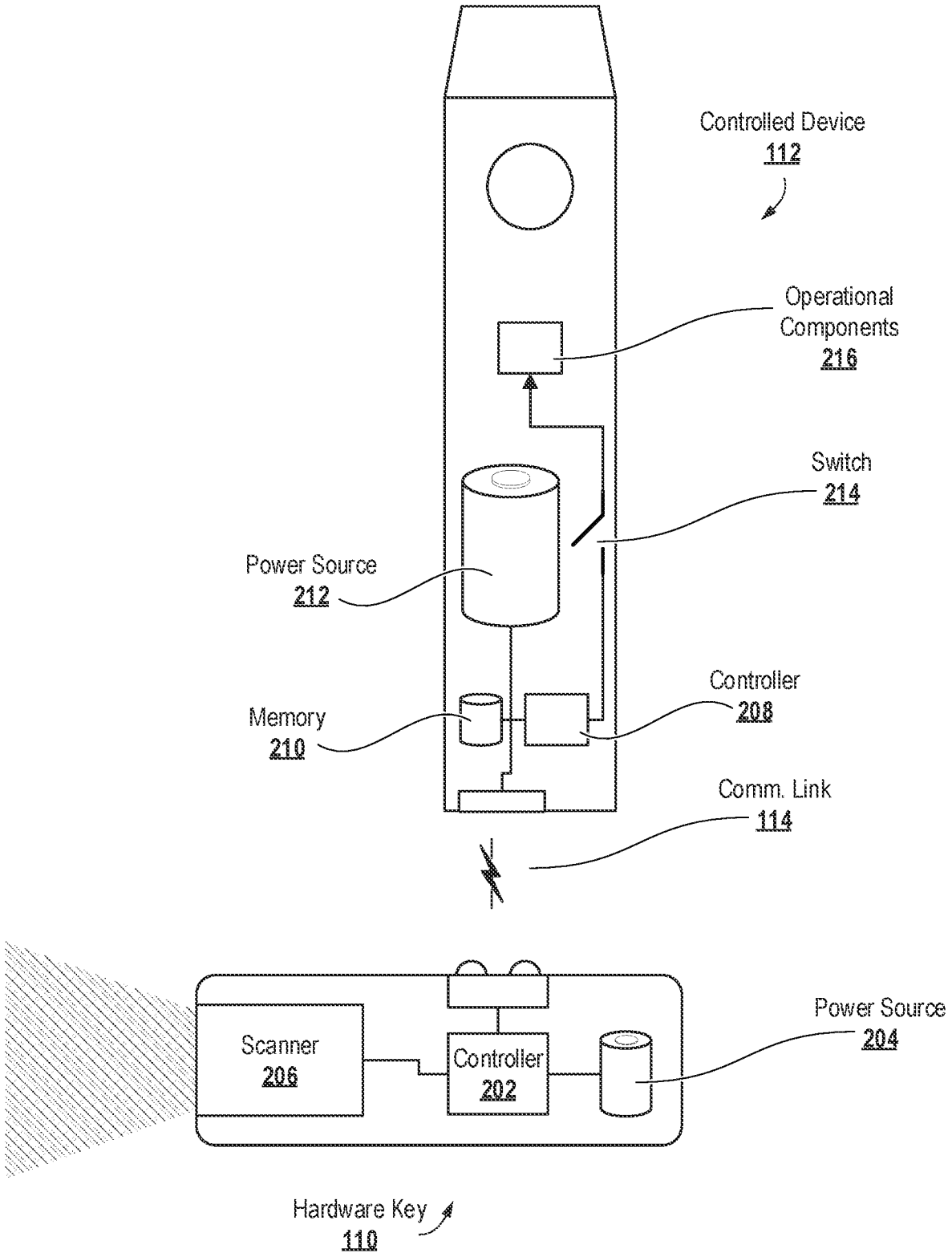
FIG. 2 illustrates a system block diagram of a hardware authenticator key and a controlled device.

FIG. 2 illustrates a system block of a hardware authenticator key 110 and a controlled device 112. The hardware authenticator key 110 communicates with the controlled device 112 via communications link and is generally configured to pass an activation code to the controlled device 112 enabling operation of the controlled device 112.

The hardware authenticator key 110 includes a controller 202, which is powered from a power source 204 and operates the communications link 114 and scanner 206, as well as other components that are not illustrated. The controller 202 can include a memory, such as a read-only memory (ROM) or other memory that includes a private key uniquely associated with the hardware authenticator key 110.

The scanner 206 can be an optical type scanner such as a barcode or QR code scanner. In some implementations the scanner 206 is a CMOS camera, CCD type scanner, laser reader, or an antenna configured to receive NFC communications or RFID signals. Regardless of particular implementation, the scanner is configured to scan a machine readable code that has been generated for the hardware authenticator key 110 and provide it to the controller 202 for extraction of an activation code.

Power source 204 can be a battery, external power supply, capacitor or other device suitable for supplying required electrical power throughout the hardware authenticator key 110. In some implementations, power source 204 is a rechargeable battery, and hardware authenticator key 100 can be recharged periodically using, for example, USB, wireless charging, or other methods.

Controller 202 is configured to extract an activation code from the scanned machine readable code provided by scanner 206. In some implementations the extracted activation code is initially encrypted using an asymmetric or symmetric encryption algorithm. The controller 202 then decrypts the activation code using a key stored in an onboard memory. For example, the activation key can have been encrypted using a public key of the hardware authenticator key 110 using a digital signature standard (DSS), a Rivest Shamir Adleman (RSA) algorithm, or an elliptic curve cryptography (ECC) algorithm, among others. The private key of the hardware authenticator key 110, stored exclusively on the hardware authenticator key's 110 memory can then be used to decrypt the activation key. Once the controller 202 has the decrypted activation key, it can transmit it (e.g., via communications link 114) to the controlled device 112.

In some implementations, controller 202 directly writes the decrypted activation code to memory 210 on the controlled device. In some implementations controller 202 communicates the activation code to controller 208, which stores it in memory 210. Controller 208 can be configured to activate (e.g., close) switch 214 if the correct activation code is stored in memory 210. Closing switch 214 enables power to flow from power source 212 (which can be similar to or different from power source 204) to the operational components 214 of controlled device 212.

In some implementations, for example where controlled device 212 is a personal electronic vaporizer, the operational components 216 can include a puff sensor, heating element, valves, or other necessary components for operation of controlled device 112. In another example, where the controlled device is a firearm, the operational components 216 can be a mechanical safety, or a trigger mechanism, among other things. In some implementations, switch 214 is an electronic switch (e.g., a field-effect transistor, or an insulated-gate bipolar transistor). In another example, the controlled device could be a container for prescription medicine, and the switch 214 is a release that allows opening of the container. In some implementations, switch 214 is a mechanical switch or servo mechanism, and controller 208 sends an electronic actuation signal to physically move the mechanical switch.

Figure 3:
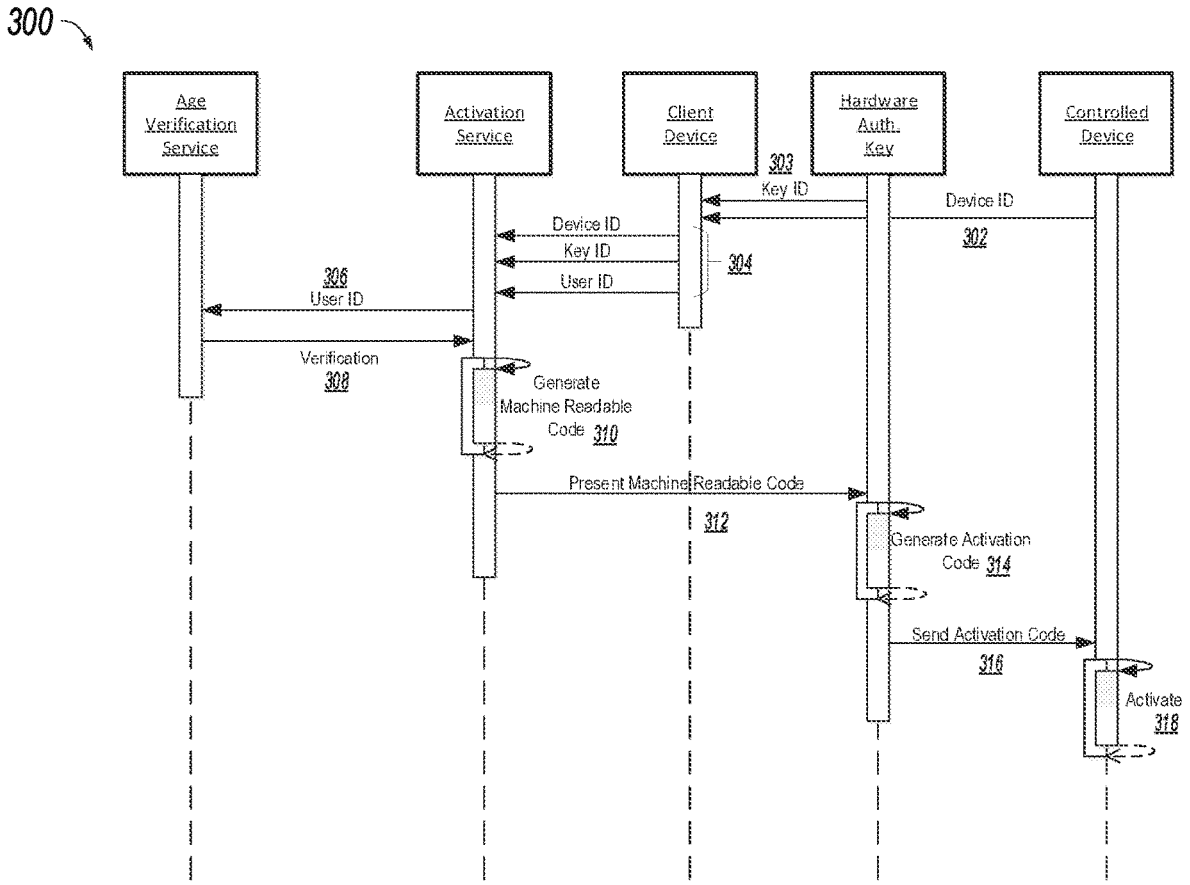
FIG. 3 is a swim lane diagram illustrating an example process for securely activating a controlled device.

FIG. 3 is a swim lane diagram illustrating an example process for securely activating a controlled device. Illustrated in FIG. 3 there are five entities interacting to securely activate the controlled device. The controlled device itself, a hardware authenticator key, a client device, an activation service, and an age verification service. It should be noted that one or more of these entities can be combined, or separated in certain implementations. For example, the hardware authenticator key and controlled device may be a single integrated device. In another example, the hardware authenticator key performs the actions of the client device. In yet a third example, the age verification service can be integral to, or performed by the same system that performs the activation service.

Initially, the client device, which can be a user mobile device (e.g., smartphone, laptop, etc.) or other terminal, receives a device ID of the controlled device to be activated (302) and a key ID of a hardware authenticator key to be used in activating the controlled device (303). In some implementations, this information is manually input to the client device. In some implementations, the user logs into a personal account on the client device, which includes one or more associated key ID's that have been stored from previous sessions. In some implementations, a sensor (e.g., camera, or other scanner) on the client device is used to scan a code (e.g., barcode or QR code) on the controlled device in order to obtain the device ID and/or the key ID.

The client device then sends an activation request message to an activation service. The activation request message includes the device ID (indicating the particular device to be activated), the key ID (indicating which particular hardware authenticator key will do the activating), and a user ID of the user operating the client device (304). The activation request message can include additional information, such as credentials, security tokens, timestamps, or other elements. The activation service then authenticates the user by sending the user ID and, in some implementations, associated credentials to an age verification service (306), which confirms the user is authorized to activate the controlled device. In some implementations the age verification service verifies that the user is at least 18 years of age. The age verification service sends back a verification message (308) indicating that the user is authorized to activate the controlled device.

The activation service then generates a machine readable code for activating the controlled device (310). The machine readable code can be a bar code, QR code, wireless code (e.g., RFID or NFC) or other suitable code that is readable by a computing device, but not immediately interpretable by a human being. The machine readable code includes an embedded activation code that is uniquely associated with the particular controlled device to be activated. In some implementations the activation code is generated based on the device ID, and is required by the controlled device in order for the device to operate. In some implementations the embedded activation code is encrypted such that only the hardware activation key can extract the activation code from the machine readable code. In some implementations the activation code is encrypted using symmetric encryption, where the encryption key is shared between the hardware authenticator key and the activation service. In some implementations, the activation key is encrypted using asymmetric encryption, and a public key of the hardware authenticator key is used to encrypt the activation code, with the associated private key exclusively stored on the hardware authenticator key. In some implementations, the activation code includes a timestamp, or an expiry timer, and therefore is only functional for a limited period of time.

The machine readable code is presented to the hardware authenticator key (312). This can be, for example, a QR code displayed on a display device. In some implementations, the activation service sends the machine readable code back to the client device, which displays it for scanning by the hardware authenticator key. In some implementations, the activation service transmits the machine readable code directly to the hardware authenticator key (e.g., via the internet, or cellular communication signals such as 4G/5G).

Upon receipt of the machine readable code the hardware authenticator key generates or extracts the activation code (314). In some implementations, the hardware authenticator key decrypts the authentication code using its private key. In some implementations, the hardware activation key augments the embedded activation code with a timestamp, or other elements, before sending the activation code to the controlled device 316.

The controlled device then activates based on receipt of the activation code (318). In some implementations the controlled device will activate for a predetermined period of time. For example, the activation code can be stored in a local onboard memory, and a controller can periodically confirm that the activation code is present during a period of time where an activation switch is closed. In some implementations, the controller can be configured to periodically erase the onboard memory, thus limiting the period of time in which the device is activated. In some implementations, the controller erases the memory and deactivates the device in response to a predetermined condition. For example, where the controlled device is a personal vaporizer, after a certain number of "puffs" or when the battery gets below a certain state of charge, the controlled device can deactivate, and require a new activation code in order to operate again.

Figure 4:
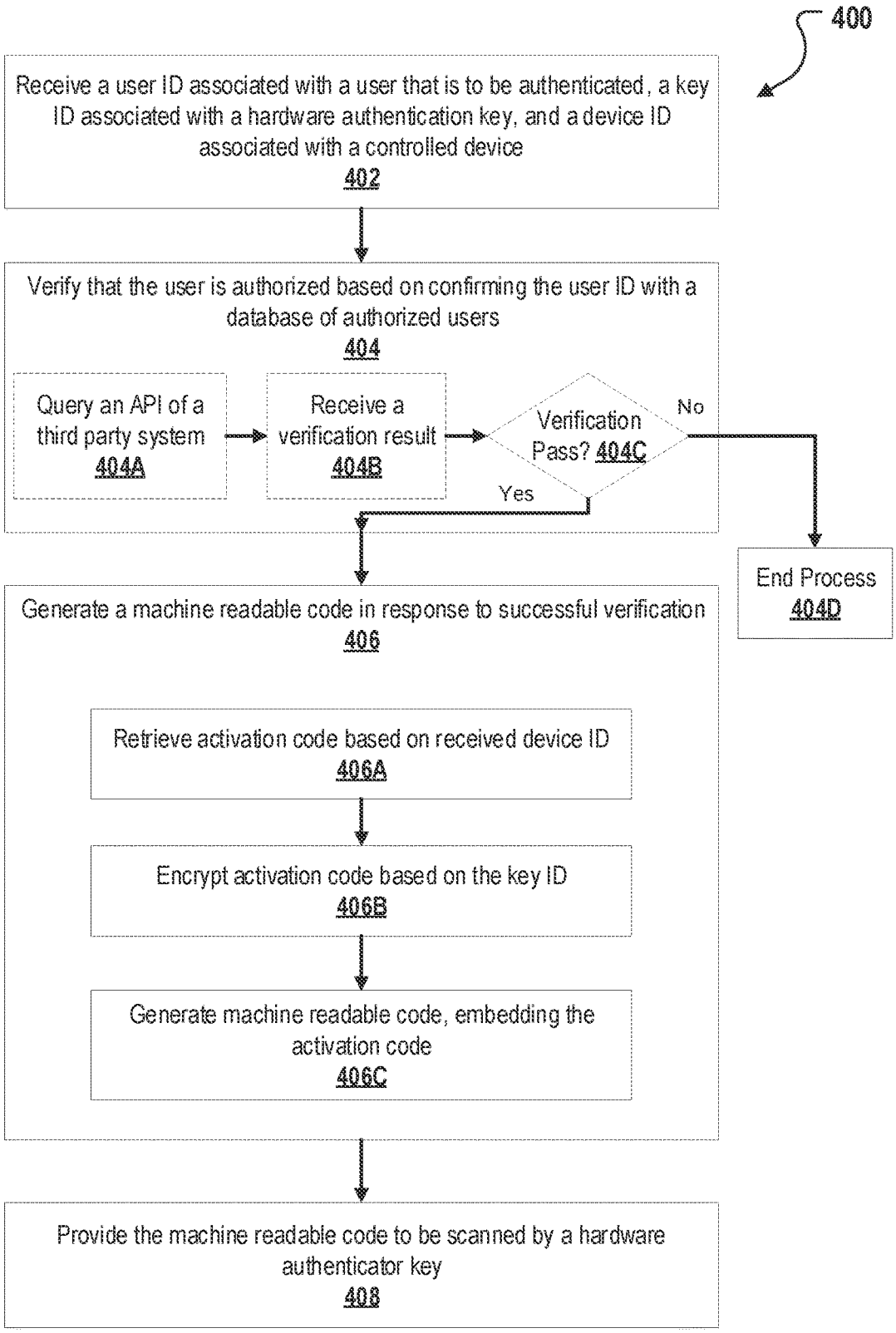
FIG. 4 is a flowchart depicting an example process for generating a machine readable code to activate a controlled device.

FIG. 4 is a flowchart depicting an example process for generating a machine readable code to activate a controlled device. It will be understood that process 400 may be performed, for example, by any suitable system, environment, software, and hardware, or a combination of systems, environments, software, and hardware as appropriate. In some instances, process 400 can be performed by the system 100, or portions thereof, described in FIG. 1, as well as other components or functionality described in other portions of this description. In other instances, process 400 may be performed by a plurality of connected components or systems. Any suitable system(s), architecture(s), or application (s) can be used to perform the illustrated operations.

At 402, a message is received including a unique ID associated with a user that is to be authenticated. The message, or follow-on messages, also include a key ID associated with a hardware authenticator key that is to be used to activate the controlled device, and a device ID that uniquely identifies the controlled device.

At 404, the user is authenticated, or verified to be authorized to activate the controlled device based on comparing the user ID with a database of authorized users. In some implementations, an activation service maintains a database of authorized users locally. In these implementations, users can have registered with the database prior to process 400 initiating. They can, for example, provide a photo ID, or an image of their drivers license, among other things to initially establish that they're authorized. The user ID can then act as a proxy for the user to confirm that they are authorized (e.g., of age, not a felon, etc.).

In some implementations, the authorization of the user relies on a third party system. At 404A, a query is sent to an API of a third party system (e.g., bluecheck.me, agechecker.net, clearme.com, etc.) and the third party system performs the verification before returning a verification result at 404B. In some implementations the third party system is a government database, or a regulatory system. For example, the user can be authorized by correlating driver's license number with a government database of licensed users. In some implementations, the authorization is specific to the particular controlled device being authorized. For example, if the controlled device is a personal vaporizer that contains THC, it may have a different subset of authorized users (e.g., a different legal age), as compared to a personal vaporizer that contains tobacco. In implementations where the personal vaporizer has a removable/exchangeable cartridge, the user authorization can be required every time the cartridge is changed. For example, the device can de-activate upon removal of a cartridge, and require process 400 to repeat with a new device ID (that includes the new cartridge). At 404C, if they user ID did not pass the age verification, process 400 can halt at 404D. In some implementations an error message, or a "user not authenticated" message is returned to the user in response to a failed age verification. If the verification passes, process 400 proceeds to 406.

At 406, a machine readable code is generated in response to a successful verification. The machine readable code can be generated based on the device ID and the key ID. At 406A, an activation code is retrieved based on the device ID. The activation code can be unique to the particular controlled device to be activated, and can be for example, stored in a database of activation codes as a value in a key value pair, where the key is the device ID. In some implementations, the activation code is a processed version of the device ID. For example, a secret salt can be added to the device ID and then a hashing algorithm performed on the salt and the device ID to generate the activation code. In general, the activation code uniquely works to activate a single controlled device, which requires that specific code to activate. At 406B the activation code can be encrypted based on the key ID. In some implementations the activation code is encrypted using asymmetric encryption and the public key of the hardware authenticator key. In this manner, only the hardware authenticator key will be the only device capable of extracting or decrypting the activation code, ensuring that if the machine readable code is intercepted, it is not usable to an unauthorized user or device. At 406C the machine readable code is generated, with the activation code embedded. The machine readable code can be a bar code, or a QR code, or any suitable machine readable code that allows for scanning by a hardware authenticator key.

At 408, the machine readable code is presented for scanning by the hardware authenticator key. The machine readable code can be presented in a display, or as a radio transmission, or an audio transmission, among other things.

Figure 5:
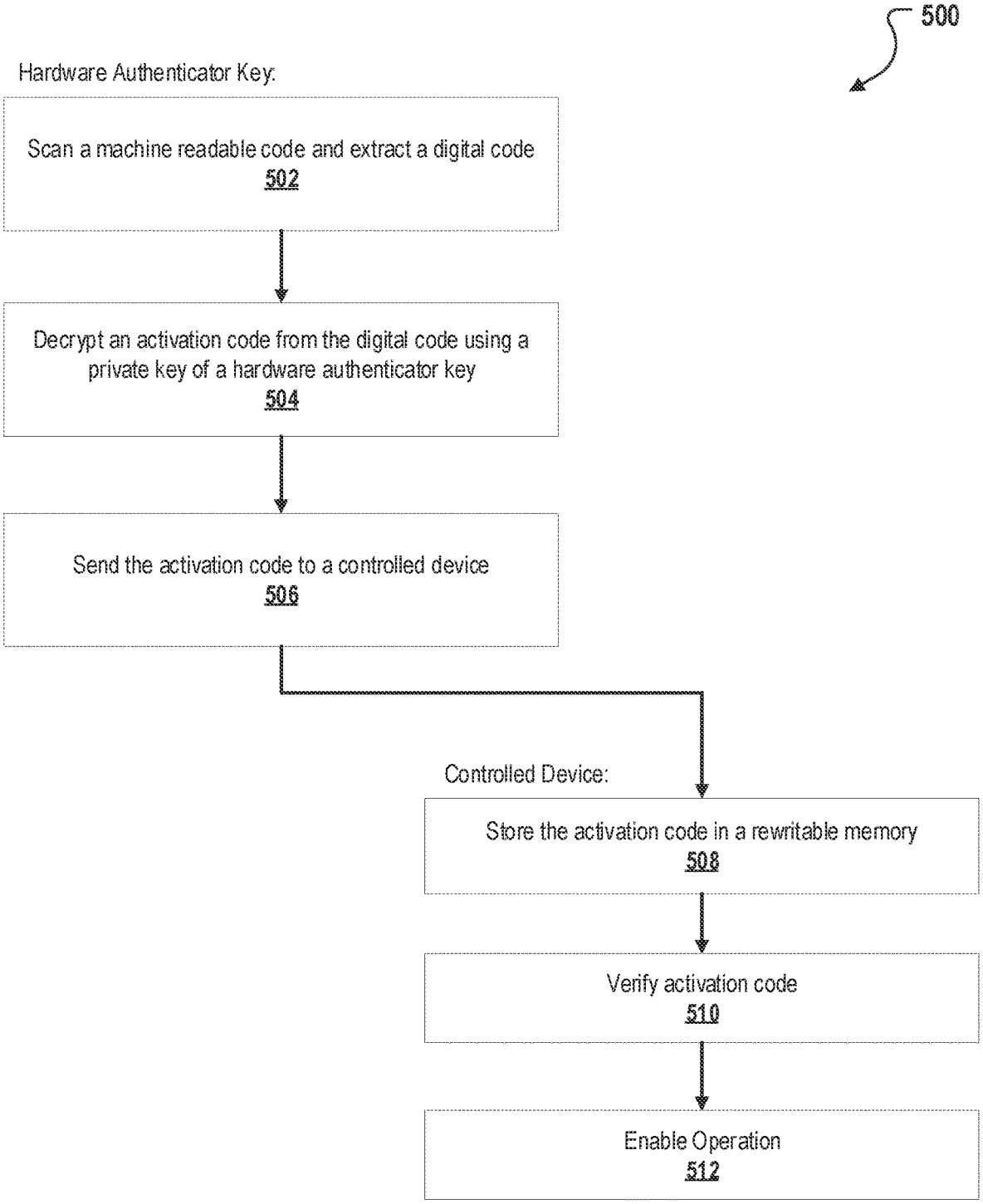
FIG. 5 is a flowchart depicting an example process for using a machine readable code to activate a controlled device.

FIG. 5 is a flowchart depicting an example process for using a machine readable code to activate a controlled device. It will be understood that process 500 may be performed, for example, by any suitable system, environment, software, and hardware, or a combination of systems, environments, software, and hardware as appropriate. In some instances, process 500 can be performed by the system 100, or portions thereof, described in FIG. 1, as well as other components or functionality described in other portions of this description. In other instances, process 500 may be performed by a plurality of connected components or systems. Any suitable system(s), architecture(s), or application (s) can be used to perform the illustrated operations.

502 through 506 of process 500 can be performed by a hardware authenticator key, while 508-512 can be performed by the controlled device itself. In some implementations, the hardware authenticator key and the controlled device are separate devices that communicate only when coupled together (e.g., plugged in or otherwise mated). In some implementations, the hardware authenticator key is integral to the controlled device, and functions as a part of the controlled device.

At 502, the hardware authenticator key scans a machine readable code to extract a digital code. The digital code can be a numeric representation of the machine readable code. For example, where the machine readable code is a barcode, the digital code can be a 12 digit alphanumeric that represents that barcode. The machine readable code can be scanned, for example, using a laser scanner, optical scanner, microphone (where the machine readable code is audio), or other suitable sensor.

Once the digital code has been extracted, at 504, the hardware authenticator key decrypts an activation code from the digital code using its private key. This decrypted activation code can represent a unique code required by the controlled device for operation.

At 506, the activation code is sent to the controlled device. In some implementations, the activation code is sent using one way serial communications, and is directly and automatically written to a memory of the controlled device. In some implementations a UART communications interface is used, and when the hardware authenticator key is plugged into the controlled device, it automatically transmits the activation code to the controlled device.

At 508 the activation code is stored in a rewritable memory of the controlled device. This rewritable memory can be accessed by multiple components, such as a controller of the controlled device. In some implementations, the controlled device uses a micro controller or other chip, such as an ATTINY402 to perform operations as well as activation.

At 510, the controlled device, prior to enabling operation, verifies it has a valid activation code stored in the rewritable memory. If a valid activation code is stored, then process 500 can proceed to 512.

At 512, operation of the controlled device is enabled. Enabling the controlled device can include manipulating a switch (e.g., closing a switch). In some implementations, activating the controlled device includes toggling an electronic switch (e.g., a field-effect transistor, or an insulated-gate bipolar transistor). In another example, the controlled device could be a container for prescription medicine, and the switch is a mechanical release that allows opening of the container. In some implementations, the switch is a mechanical switch or servo mechanism, and an electronic actuation signal physically moves the mechanical switch in order to activate the controlled device.

Figure 6:
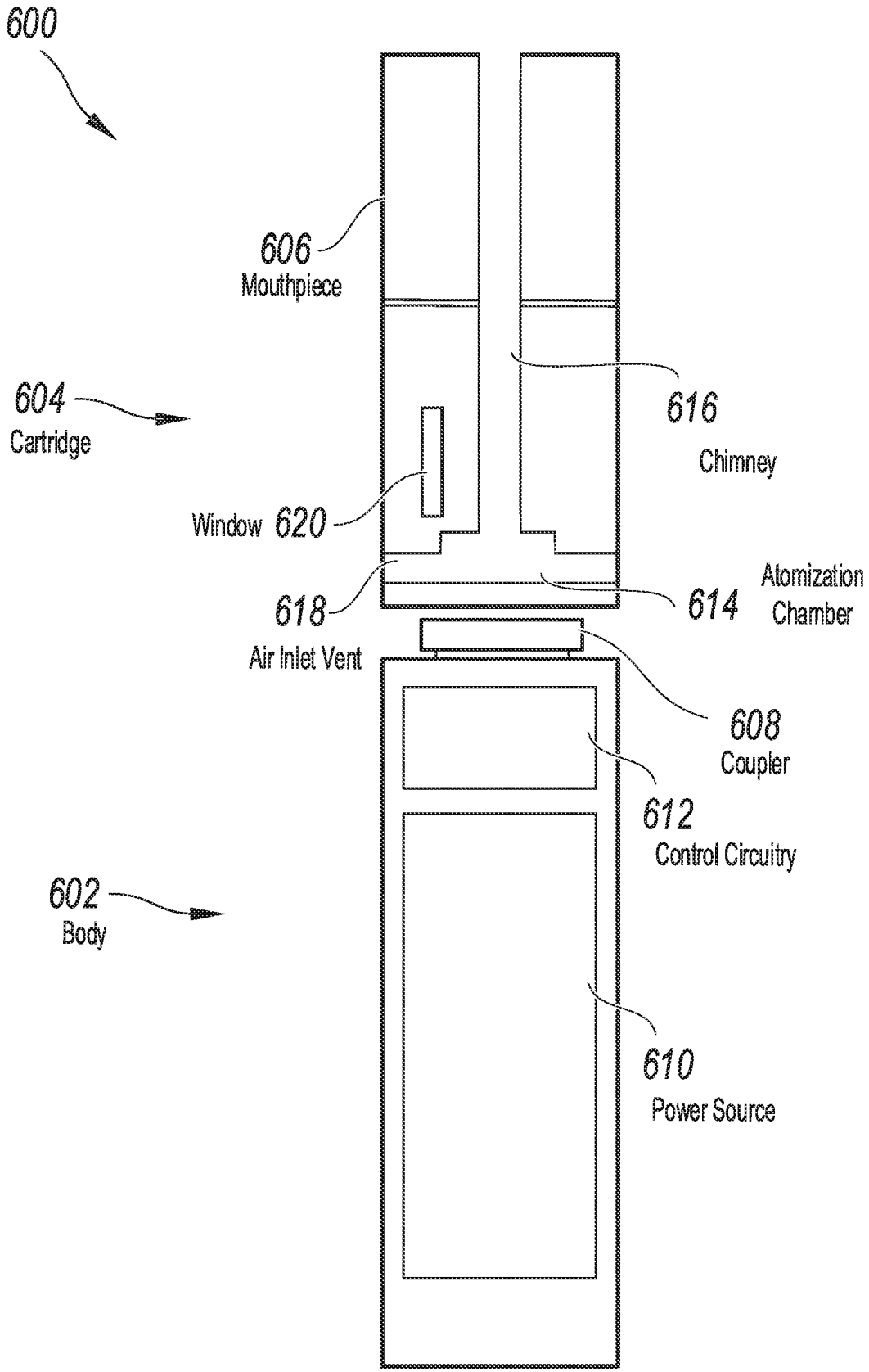
FIG. 6 illustrates a schematic half cross-sectional view of an example personal vaporizer, with some internals shown.

FIG. 6 illustrates a schematic partial half cross-sectional view of an example personal vaporizer 600, with some internals shown. Personal vaporizer 600 includes a body portion 602, cartridge 604, and mouthpiece 606. In the illustrated implementation, the mouthpiece 606 is integral to the cartridge 604. In the illustrated implementation, the cartridge 604 is removable from the body 602 via a coupler 608. The coupler 608 can have two parts, one that is part of the cartridge portion or mouthpiece portion 606 and one that is part of the body portion 602, e.g., one part being female and configured to receive the other, male, part. The coupler 608 can be, for example, threads, a lug/channel connector, a recessed magnetic connector, or other suitable manner for coupling the two portions of the personal vaporizer 600. In addition, an electrical connection can also be facilitated in the connection between the coupler 608. Similarly, in some instances, the mouthpiece 606 is removable from the cartridge 604 via a similar coupler or a different coupler (not shown).

The body 602 includes a power source 610, which can provide electrical power to control circuits 612, and a heating element in the atomization chamber 614. In certain instances, the power source 610 includes a battery, such as a lithium ion (Li-ion), nickel metal hydride (NiMH), Alkaline or other battery. In some implementations, the battery is user replaceable. In some implementations, the battery is integrated with the body 602. In some implementations, power source 610 also includes charging circuitry required for recharging the battery. A charging port (not shown) can be provided on the body 602, to allow recharging of the power source 610 as well as communications between the personal vaporizer 600 and external systems. The charging port can be, for example, a USB-C, Micro-USB, 2.5 mm port, or other suitable port for providing electrical power and/or data to the personal vaporizer 600.

Control circuitry 612 includes necessary circuitry to operate the personal vaporizer 600. Control circuitry 612 can include one or more microcontrollers and/or analog circuits, as well as sensors for operation and one or more memories. A puff sensor in the control circuitry 612, detects whether or not a user is drawing on the mouthpiece. In certain instances, the puff sensor is a microphone, or a diaphragm based pressure sensor or other pressure sensor, and/or another type of puff sensor. In some implementations, the control circuitry 612 can detect whether or not a cartridge is installed. In some instances, the control circuitry 612 can communicate systems external to the personal vaporizer 600. For example, control circuitry 612 provides data, including battery state of charge, remaining substance level in the cartridge, and/or other data to a user's mobile device (e.g., via bluetooth, WIFI, or USB connection). The control circuitry 612 can be used to render the device inoperable. For example, the personal vaporizer 600 can be sold with a memory of the control circuitry 612 that is empty. The control circuitry 612 can then prevent power supply to the atomization chamber 614 or from the power source 610 generally, until an activation code is written to the memory.

Cartridge 604 includes an atomization chamber 614, through which air flows past a heating element and a wick that is exposed to a substance to be atomized. The atomized vapor can leave the vaporization chamber with the flowing air through a passage or chimney 616. Cartridge 604 further includes a reservoir that contains the substance to be atomized. In some implementations, a puff sensor is located in the cartridge 604, and communicates with control circuitry 612 when the cartridge 604 is coupled with the body 602. One or more air inlet vents 618 are provided on the cartridge 604 for allowing airflow into the cartridge 604 when the user draws air through the personal vaporizer 600. In some implementations, the reservoir includes a clear or translucent window 620 to the exterior of the cartridge 604 for visually determining the amount of substance within the reservoir. While illustrated as a relatively small window 620, in some implementations, an external shell of the cartridge 604 is formed of a translucent or transparent material, resulting in a window 620 that covers a majority of the exterior of the cartridge 604.

Mouthpiece 606 includes the chimney 616 and provides a flow path through the atomization chamber 614 into the user's mouth when the mouthpiece is coupled to the cartridge 604. The mouthpiece 606 can have a rubberized or textured outer surface to increase comfort and aid in the user achieving a seal between the mouthpiece 606 and their lips.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can, in some cases, be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The foregoing description is provided in the context of one or more particular implementations. Various modifications, alterations, and permutations of the disclosed implementations can be made without departing from scope of the disclosure. Thus, the present disclosure is not intended to be limited only to the described or illustrated implementations, but is to be accorded the widest scope consistent with the principles and features disclosed herein.

In other words, although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A method for activating a personal vaporizer comprising:

receiving, at a computing device, a user identification (ID) associated with a user that is to be authenticated;

verifying, by the computing device, that the user is authorized based on confirming the user ID with a database of authorized users;

receiving a device ID that uniquely identifies a personal vaporizer to be activated and a key ID that uniquely identifies a hardware authenticator key configured to activate the personal vaporizer;

generating, by the computing device, a machine readable code in response to a successful verification, the machine readable code comprising an activation code configured to enable operation of the personal vaporizer, wherein the machine readable code is generated based on the device ID and the key ID; and providing the machine readable code to be scanned by the hardware authenticator key.

2. The method of claim 1, wherein generating the machine readable code comprises generating a QR code, and wherein providing the machine readable code to be scanned comprises presenting the QR code on a display device associated with the computing device.

3. The method of claim 1, wherein the activation code, when transmitted by the hardware authenticator key to the personal vaporizer, enables operation of the personal vaporizer.

4. The method of claim 1, wherein generating the machine readable code comprises:

retrieving the activation code from a repository, wherein the activation code is specific to the personal vaporizer to be activated; and generating the machine readable code to be specific to the hardware authenticator key based on the key ID.

5. The method of claim 4, wherein the activation code is embedded into the machine readable code using a public key of the hardware authenticator key, and wherein the activation code is configured to be extracted from the machine readable code using a private key of the hardware authenticator key.

6. The method of claim 1, wherein verifying that the user is authorized comprises querying an API of a third party system.

7. The method of claim 1, wherein verifying that the user is authorized comprises receiving biometric information associated with the user and verifying the biometric information.

8. A non-transitory computer-readable medium storing one or more instructions executable by a computer system to perform operations comprising:

receiving, at a computing device, a user identification (ID) associated with a user that is to be authenticated;

verifying, by the computing device, that the user is authorized based on confirming the user ID with a database of authorized users;

receiving a device ID that uniquely identifies a personal vaporizer to be activated and a key ID that uniquely identifies a hardware authenticator key configured to activate the personal vaporizer;

generating, by the computing device, a machine readable code in response to a successful verification, the machine readable code comprising an activation code configured to enable operation of the personal vaporizer, wherein the machine readable code is generated based on the device ID and the key ID; and providing the machine readable code to be scanned by the hardware authenticator key.

9. The computer-readable medium of claim 8, wherein generating the machine readable code comprises generating a QR code, and wherein providing the machine readable code to be scanned comprises presenting the QR code on a display device associated with the computing device.

10. The computer-readable medium of claim 8, wherein the activation code, when transmitted by the hardware authenticator key to the personal vaporizer, enables operation of the personal vaporizer.

11. The computer-readable medium of claim 8, wherein generating the machine readable code comprises:

retrieving the activation code from a repository, wherein the activation code is specific to the personal vaporizer to be activated; and generating the machine readable code to be specific to the hardware authenticator key based on the key ID.

12. The computer-readable medium of claim 11, wherein the activation code is embedded into the machine readable code using a public key of the hardware authenticator key, and wherein the activation code is configured to be extracted from the machine readable code using a private key of the hardware authenticator key.

13. The computer-readable medium of claim 8, wherein verifying that the user is authorized comprises querying an API of a third party system.

14. The computer-readable medium of claim 8, wherein verifying that the user is authorized comprises receiving biometric information associated with the user and verifying the biometric information.

15. A computer-implemented system, comprising:

one or more computers; and one or more computer memory devices interoperably coupled with the one or more computers and having tangible, non-transitory, machine-readable media storing one or more instructions that, when executed by the one or more computers, perform one or more operations comprising:

receiving, at a computing device, a user identification (ID) associated with a user that is to be authenticated;

verifying, by the computing device, that the user is authorized based on confirming the user ID with a database of authorized users;

receiving a device ID that uniquely identifies a personal vaporizer to be activated and a key ID that uniquely identifies a hardware authenticator key configured to activate the personal vaporizer;

generating, by the computing device, a machine readable code in response to a successful verification, the machine readable code comprising an activation code configured to enable operation of the personal vaporizer, wherein the machine readable code is generated based on the device ID and the key ID; and providing the machine readable code to be scanned by the hardware authenticator key.

16. The system of claim 15, wherein generating the machine readable code comprises generating a QR code, and wherein providing the machine readable code to be scanned comprises presenting the QR code on a display device associated with the computing device.

17. The system of claim 15, wherein the activation code, when transmitted by the hardware authenticator key to the personal vaporizer, enables operation of the personal vaporizer.

18. The system of claim 15, wherein generating the machine readable code comprises:

retrieving the activation code from a repository, wherein the activation code is specific to the personal vaporizer to be activated; and generating the machine readable code to be specific to the hardware authenticator key based on the key ID.

19. The system of claim 18, wherein the activation code is embedded into the machine readable code using a public key of the hardware authenticator key, and wherein the activation code is configured to be extracted from the machine readable code using a private key of the hardware authenticator key.

20. The system of claim 15, wherein verifying that the user is authorized comprises querying an API of a third party system.

* * * * *